United States Patent [19]

Rockwood et al.

[11] Patent Number: 4,990,775

[45] Date of Patent: Feb. 5, 1991

[54] RESOLUTION IMPROVEMENT IN AN ION CYCLOTRON RESONANCE MASS SPECTROMETER

[75] Inventors: Alan L. Rockwood, Amesbury, Mass., Ying Pan; D. P. Ridge, both of Newark, Del.; John Wronka, Haverhill, Mass.

[73] Assignee: University of Delaware, Newark, Del.

[21] Appl. No.: 453,037

[22] Filed: Dec. 12, 1989

Related U.S. Application Data

[63] Continuation of Ser. No. 203,311, Jun. 6, 1988, abandoned.

[51] Int. Cl.[5] ..... H01J 49/38

[52] U.S. Cl. ..... 250/291; 250/290; 250/281

[58] Field of Search ..... 250/290, 291, 281, 282, 250/423 R

[56] References Cited

U.S. PATENT DOCUMENTS

| | | | |
|---|---|---|---|
| 3,984,681 | 10/1976 | Fletcher et al. | 250/291 |
| 4,208,582 | 6/1980 | Arnush et al. | 250/291 |
| 4,500,782 | 2/1985 | Allemann et al. | 250/291 |
| 4,563,579 | 1/1986 | Kellerhals et al. | 250/291 |
| 4,581,533 | 4/1986 | Littlejohn et al. | 250/291 |
| 4,686,365 | 8/1982 | Meek et al. | 250/291 |
| 4,746,802 | 5/1988 | Kellerhals | 250/291 |
| 4,755,670 | 7/1988 | Syka et al. | 250/291 |
| 4,761,545 | 8/1988 | Marshall et al. | 250/291 |
| 4,818,864 | 4/1989 | Allemann | 250/290 |
| 4,855,593 | 8/1989 | Bodenhausen et al. | 250/291 |

*Primary Examiner*—Jack I. Berman
*Assistant Examiner*—Kiet T. Nguyen
*Attorney, Agent, or Firm*—Connolly & Hutz

[57] ABSTRACT

In an ion cyclotron resonance mass spectrometer, ion cyclotron resonance signals at higher harmonics of cyclotron frequency are employed to increase the resolution of ICR mass spectrometer without increasing the magnetic field. The detection electrodes consist of M (where M is an integer) identical electrodes arranged in M-fold symmetry about the axis of the coherent cyclotron motion of the observed ions. In an ion cyclotron having four points of voltage in space, the cyclotron electrodes are set up in clockwise symmetric fashion. To increase the resolution in signal detection resulting from the potential induced by ions moving in orbits in the specrometer, the first and third voltages are added and the second and fourth voltages are subtracted from the sum of the first and third voltages.

7 Claims, 2 Drawing Sheets

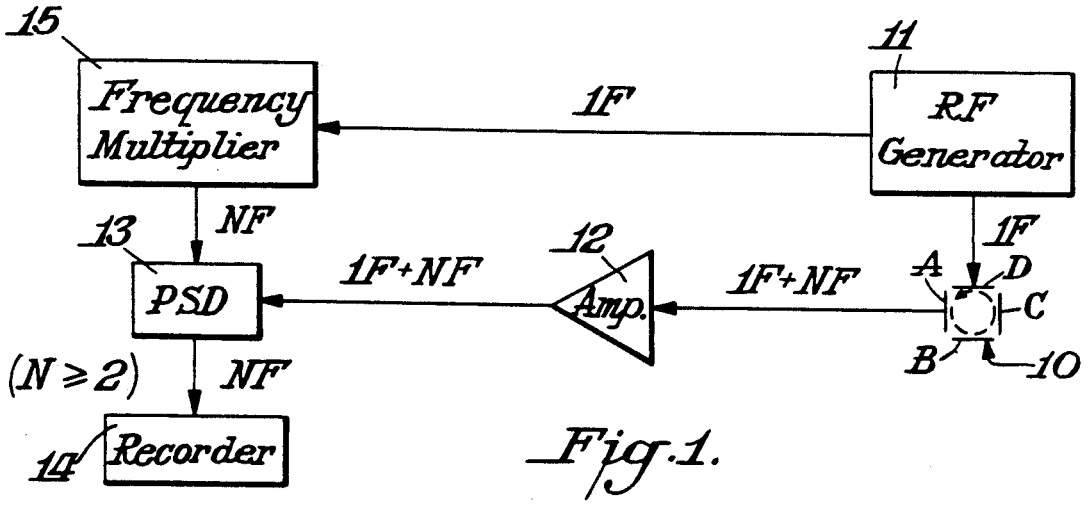
Fig. 1.
Fig. 2A.
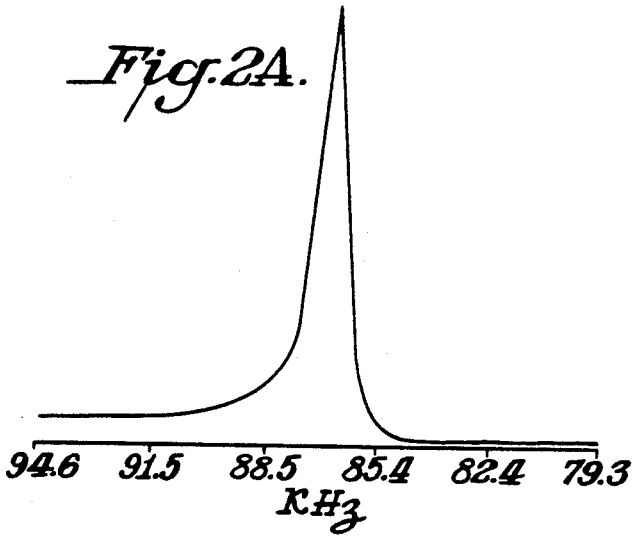
Fig. 3.
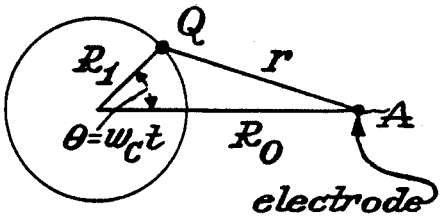
Fig. 2B.
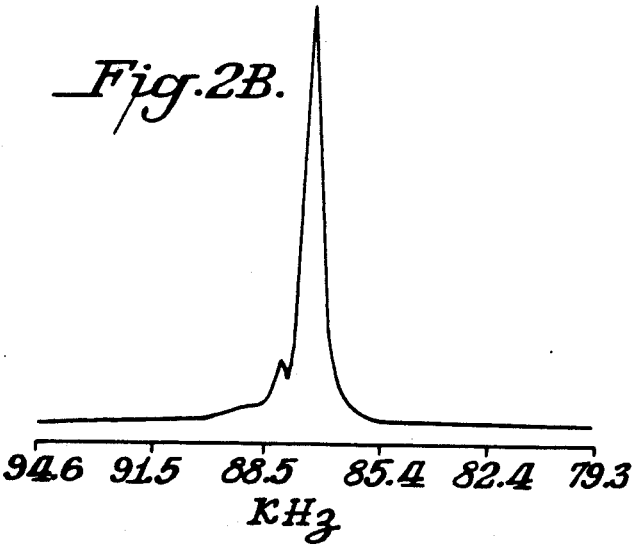
Fig. 6A.
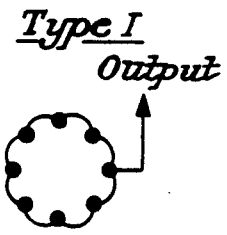
Fig. 6B.
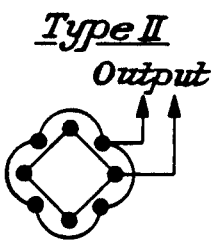

RESOLUTION IMPROVEMENT IN AN ION CYCLOTRON RESONANCE MASS SPECTROMETER

This application is a continuation of application Ser. No. 07/203,311, filed June 6, 1988 now abandoned.

INTRODUCTION

This invention relates to improvement in the resolution of the spectra in an ion cyclotron mass spectrometer by harmonic detection.

BACKGROUND OF THE INVENTION

Signals are usually detected in ion cyclotron resonance-based mass spectrometry by measuring potential changes induced by the periodic motion of the ions in "antennae" electrodes. Since the induced voltage is not linear with distance for finite electrodes, the potential induced by ions moving in orbits of non-zero radius will not have a perfect sinusoidal variation with time. The signal will, therefore, contain components at higher harmonics ($NF_e$) of the cyclotron frequency as well as at the fundamental ($F_e$) This effect does not depend on the in homogeneity of the trapping field and is, therefore, quite general. The ion cyclotron resonance experiment is usually designed to minimize harmonic signals since they can complicate proper identification of sample ions. In the usual continuous wave (cw) experiment the harmonics are not detected because of the detecting method. Usually a phase sensitive detector is used and the detector is tuned to the fundamental frequency. In the modern Fourier transform spectrometer the harmonics are suppressed by cell design and choice of operating conditions.

SUMMARY OF THE INVENTION

It is an object of this invention to increase the resolution of ICR mass spectrometry without increasing the magnetic field. This is accomplished by detecting the signal at a harmonic of the cyclotron frequency rather than at the fundamental. This may be done in a conventional ICR cell. However, much better performance is obtainable by building unconventional cells. Increased resolution of ICR mass spectroscopy is obtained and also increased sensitivity may result.

Ion cyclotron resonance signals at higher harmonics of the cyclotron frequency are described. If dissipation of the charge in an orbiting charge packet depends only on time, the linewidths of the signals at all harmonics are the same. The spacing between mass lines increases with harmonic order, therefore resolution increases linearly with harmonic order. Selection rules are developed for a class of detection schemes that will detect selected harmonics. The detection electrodes for this class of detectors consists of M (where M is an integer) identical electrodes arranged with M-fold symmetry about the axis of the coherent cyclotron motion of the observed ions. The sum of the signals from all the electrodes contains harmonics of order Mk (k is an integer). The difference between the sum of the signals from every other electrode and sum of the signals from the remaining electrodes contains harmonics of order $M(2k-1)/2$ (in this case M must be even). This suggests that it is possible to detect harmonics of arbitrary order in the absence of harmonic signals of lower order. This could be useful in improving resolution in ion cyclotron resonance mass spectroscopy without increasing data acquisition time or magnetic field strength.

Stated otherwise, the present invention provides in an ion cyclotron that with four points of voltage in space, subtracting the voltage of the first point from that of the second point and adding the voltage of the third point and then subtracting the voltage at the fourth point. The electrodes are set up in clockwise symmetric fashion. The effect of the invention, can be seen from providing that the first and third voltages are added and the second and fourth voltages are subtracted from the sum of the first and third voltages. Then the first harmonic and all higher odd harmonics disappear by symmetry and only even harmonics remain.

Further, it is noted that with this arrangement of four points of voltage, the intensity of the second harmonic is twice that of the single detector embodiment.

In general, it has been discovered that for every number of electrodes symmetrically spaced all harmonics less than N/2 disappear by symmetry and at N/2 or over some harmonics are enhanced and some not.

This invention will be better understood in view of the following description taken with the following drawings.

BRIEF DESCRIPTION OF THE DRAWINGS

In the accompanying drawings, FIG. 1 shows an arrangement in block diagram for continuous wave ICR harmonic detection;

FIGS. 2*a* and 2*b* show cyclotron resonance signals;

FIG. 3 is a coordinate diagram of a point electrode;

FIGS. 6*a* and 6*b* illustrate arrangements of multiple electrodes according to this invention.

DESCRIPTION OF THE EMBODIMENTS

Figure 4:
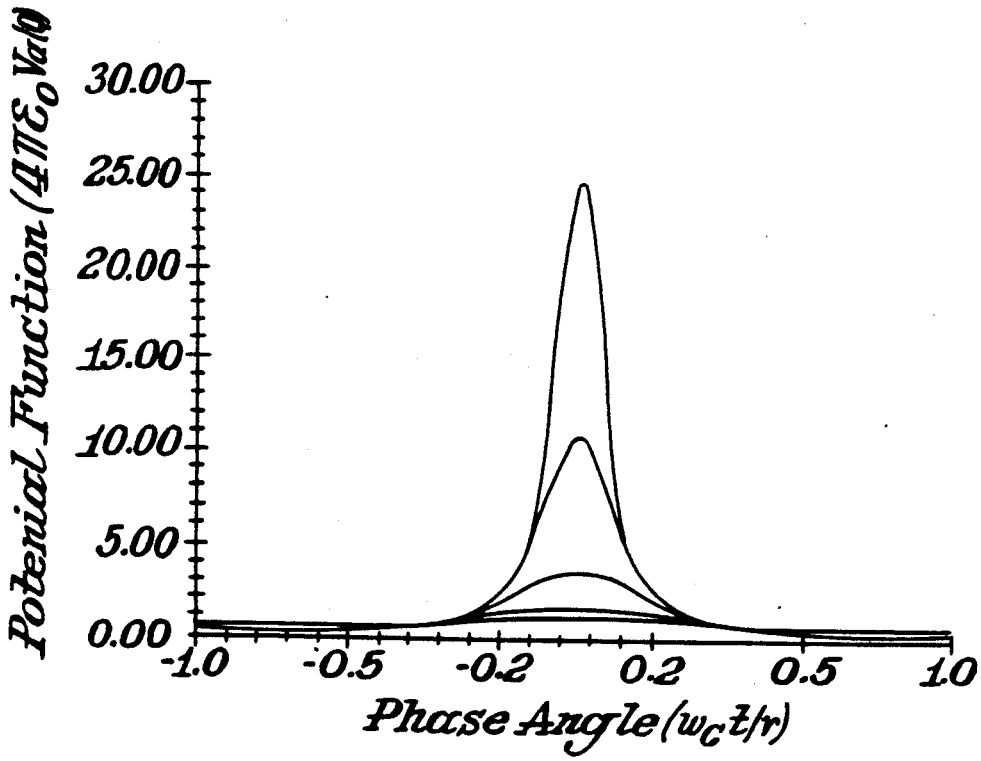
FIG. 4 is a plot of the potential function with phase angle.

Phase sensitive detectors tuned to a fundamental frequency have been disclosed.

FIG. 1 illustrates an arrangement which provides a second harmonic that occurs at twice the fundamental frequency and accordingly the resolution is twice that of the fundamental spectrum. In FIG. 1, a cell 10 has plates A, B and C which detect a second harmonic. RF excitation is applied to plate D from a RF generator 11. The output from the plate A amplified at 12 is received by the phase sensitive detector 13 and an output is suitably recorded at recorder 14. A frequency multiplier 15 generates a new reference frequency which is at the harmonic being detected and locked in phase with the original fundamental. Detection on any of the three plates A, B or C gives the same result, that is, relative to the fundamental the resolution is improved by a factor of two.

FIG. 2 shows an illustrative example. Plate A was set up to be the detecting plate. The magnetic field strength is 1.1 Tesla. The ion detected is $Cr(CO_5^-$ formed from $Cr(CO)_6$ at $1.0\times100^{-6}$ Torr. The cubic cell of FIG. 1 is operated in the continuous trapped mode. The electron beam is continuously on, so ions are formed and drifted to the cell walls resulting in a steady state ion population. With the strongest fields occurring in the corner of the cell between the excite/detect electrodes, ions in that region will be the most strongly excited and will contribute most strongly to the signal. Such ions will also reach the walls of the apparatus quickly and have a short lifetime. The cyclotron resonance line is, therefore, lifetime broadened. As mentioned before, the resolution obtained by detecting at higher harmonics should be improved. This is shown in FIG. 2*b*. The signal intensity detected at twice the excitation frequency is plotted against the excitation frequency. The width of the resulting peak is half the width of the signal detected at the fundamental shown in FIG. 2*a*. The appearance of the isotope peak dramatizes the improved resolution.

In FIG. 2 the cyclotron resonance signal of $Cr(CO)_5^-$ is plotted versus $F_d/N$ where $F_d$ is the detection frequency and N is the order of harmonic or harmonic number. Normalizing the detection frequency in this way puts the abscissa on the same scale for all harmonics so they can be directly compared. (a) First harmonic or fundamental (N=1); (b) Second harmonic (N=2). Note the narrower linewidth and isotope peak indicating improved resolution.

Harmonics Detected by a Single Point Electrode

FIGS. 1, 2*a* and 2*b* illustrate single plate detection in which a second-order harmonic signal was detected.

In the following description of the present invention there is described the constructing of ICR cells geometrically arranged for selective harmonic detection.

The origin of harmonics in the ICR signal is illustrated and described with reference to FIG. 3. A packet of ions of total charge Q moving coherently in a circular cyclotron orbit of Radius $R_1$ is illustrated in FIG. 3. The coherent motion of the ions is the result of an excitation step. The ICR signal is detected by monitoring currents or voltages induced in antennae electrodes by this coherent ion motion. These induced signals differ significantly from pure sinusoidal waves. This difference increases as the cyclotron radius increases relative to the size of the cell. Hence, they contain high-frequency components, harmonics of the fundamental cyclotron frequency. The occurrence of harmonics in the signal obtained from a cylindrical cell has been discussed by E. N. Nikolaev and M. V. Gorshkiv, International Journal of Mass Spectrometry and Ion Processes, vol. 64, page 115 (1985). In addition, harmonics are sometimes observed in FT-ICR spectra (see paper presented at 34th Annual Conference on Mass Spectrometry June 8-13, 1986 in Cincinnati, Ohio by R. E. Shomo and others). Harmonic signals complicate assignment of masses of sample ions and their usefulness for increasing resolution has only recently been recognized. As shown in the following discussion, the problem of spectral congestion can be minimized by selectively detecting harmonic signals.

A point electrode is a simple model that ca be used to illustrate harmonic behavior. The model is defined in FIG. 3. FIG. 3 is a coordinate diagram for point electrode A interacting with a charge Q moving in a circle of radius $R_1$. The electrode is a distance $R_O$ from the center of the circle and a distance r from Q. The angular position of Q is $\theta$, or $w_c t$. The electrode is located at point A a distance $R_O$ from the center of the cyclotron orbit of ions Q. We take the electrode to be a high-impedance antenna responsive to the field at A. The potential at point A is given by $$V_a(r) = \frac{Q}{4\pi\epsilon_0 r}$$

where r is the distance between Q and A and $\epsilon_o$ is the permittivity constant. When the particle moves along its fixed circular path with an angular frequency $\omega_c$, the potential induced at point A will change periodically. This is made implicit by giving the potential in terms of the angular position of Q $$V_a(r,\theta) = \frac{Q}{4\pi r_0 R_0} = \frac{Q}{4\pi\epsilon_0 R_0[R^2 + 1 - 2R\cos(\theta)]^{\frac{1}{2}}} \quad (2)$$

where $$R = \frac{R_1}{R_0}$$

In Eq. (2), $\theta$ is the angular position of Q as shown in FIG. 1. This angle is modulated by the motion of the particle as $\theta = \omega_c t t\theta_o$. $\theta$ is the arbitrary initial angle at t=0 which, for simplicity, is set to 0. Then, Eq. (2) becomes $$V_a(R,\theta) = V_a(R,\omega_c t) = \frac{Q}{4\pi\epsilon_0 R_0[R^2 + 1 - 2R\cos(\omega_c t)]^{\frac{1}{2}}} \quad (3)$$

This function is plotted through one cycle for R=0.1, 0.3, 0.5, 0.7 and 0.8 in FIG. 4. FIG. 4 shows the potential from Eq. (3) of a point A as a result of motion a charge Q around a circle of radius $R_1$ whose center is a distance $R_O$ from A. The potential is given in terms of $R = R_1/R_O$ and $\omega_c t$ where $\omega_c$ is the angular velocity of Q. From the top, R=0.8, 0.7, 0.5, 0.3 and 0.1. The function is obviously not sinusoidal for large values of R, which corresponds to large values of the radius of the cyclotron motion. As R grows, the relative importance of harmonics in the signal grows. Since $Va(R\omega_c t)$ is a bounded periodic function (for R<1), this can be shown explicitly by representing it as a Fourier series $$V_a(R,\omega_c t) = \frac{A_o}{2} + \sum_{n=1}^{\infty} A_n(R)\cos(n\omega_c t) \quad (4a)$$

where $$A_n(R) = \frac{2}{\pi}\int_0 V_a(R,\omega_c t)\cos(n\omega_c t)d(\omega_c t) \quad (4b)$$

(Because of symmetry, it is only necessary to integrate over half a period.)

Figure 5:
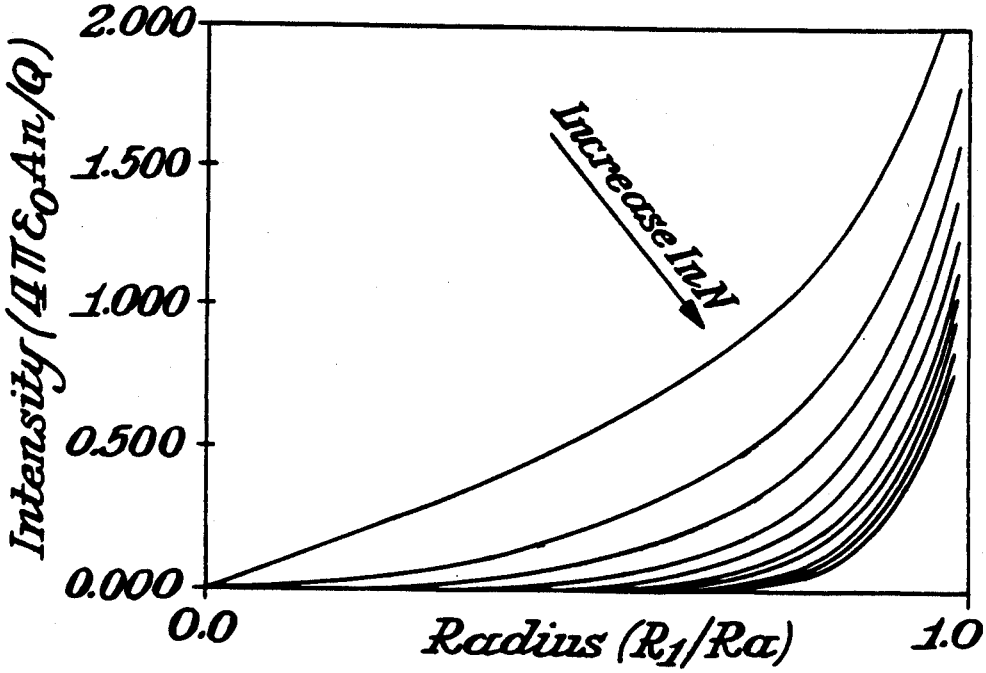
FIG. 5 is a plot of the potential at a point resulting from the motion of a charge.

The integrals ca be done numerically and the results are shown in FIG. 5. FIG. 5 shows coefficients, $A_n$, of the expansion in Eq. (4) of the potential at a point, A, resulting from the motion of charge Q in a circle of radius $R_1$. The center of the circle is $R_0$ from A. The $A_n$ are plotted as a function of $R = R_1/R_O$. Harmonic order N=1-10. The coefficients of the various harmonic terms $A_n(R)$ are plotted against R. At small R, the higher harmonic coefficients are small, but they increase dramatically at larger R. Inspection of FIG. 5 suggests that $A_n(R) \sim R^n$ at small R. Appendix A shows that this is true.

While the results illustrated in FIGS. 4 and 5 are for an idealized point electrode, qualitatively similar results apply for real electrodes. The case that has been previously considered in the most detail is the cylindrical cell. In this case, the harmonics also increase linearly with $R^n$ for small R. The harmonics become increasingly important at high levels of excitation. As R approaches 1, the harmonic signals approach equal intensity. In the point electrode case, the field is unbounded at $\theta=0$ and $R=1$. The signal is a delta function which will have all harmonics equally in its Fourier series. Qualitatively similar effects can be expected to obtain for essentially any practical electrode.

Mass Resolution In Harmonic Signals

Representing the signal as a Fourier series makes it possible to specify the peak shape and resolution of the harmonic signal components. Even if the electrode is not a point but has some shape and size, the signal it senses as a result of the cyclotron motion of the ions will be a periodic function of wt. It will not, in general, be perfectly sinusoidal, but it will be expressible as a Fourier series analogous to that of Eq. (4). If the total charge, Q, moving coherently dissipates according to f(t) as a result of collisions, reactions, or other processes, then the signal, S, will be given by $$S = f(t) \sum_n A_n \cos(n\omega_c t) \tag{5}$$

By the convolution theorem (see Modulation, Noise and Spectral Analysis, P. F. Panter, McGraw-Hill, New York 1965, pages 36–38), this signal in the frequency domain will consist of peaks centered at the harmonic frequencies with line shapes corresponding to the Fourier transform of f(t). If f(t) is an exponential, exp(−kt), for example, the line shapes will be Loretnzian with half-width k. This implies that mass resolution will increase linearly with harmonic order. If two ions have cyclotron frequencies which differ by $\Delta\omega$, for example, their signals at the nth harmonic will be at frequencies differing by $\eta\Delta\omega$. Since the linewidths, k, are the same for all harmonics, then the resolution becomes $\eta\Delta\omega/k$ and increases linearly with harmonic number.

This increase in resolution makes harmonic detection very useful. It does not require an increase in either the magnetic field strength or the signal acquisition time.

DESCRIPTION OF THE PREFERRED EMBODIMENT

Multiple Point Electrodes

Using more than one electrode for detection gives a stronger signal at a selected harmonic and eliminates lower harmonics. Consider, for example, the case of M point electrodes evenly distributed around the complete circle (m-fold symmetry) about the center of cyclotron motion of the ion. If $M=2$ then the difference between the signal from the two electrodes contain the harmonics of order $n=1, 3, 5, 7$, etc. If $M=4$ and the sum of the signals from an opposing pair is subtracted from the sum of the signals of the other opposing pair, the resulting signal will contain harmonics of order $n=2, 6, 10, 14$, etc. This is illustrated in FIG. 6. FIG. 4 shows an arrangement of multiple electrodes to detect harmonics of the ion cyclotron resonance signal. The electrodes have M-fold symmetry about the center of the cyclotron motion. In type I connection, the signals from all electrodes are summed. In type II connection, the signals from alternate electrodes are summed and subtracted from the sum of the signals of the remaining electrodes. M=the number of electrodes. Similar rules apply for electrode arrays with higher symmetry. The rules apply to three-dimensional electrodes as well as point electrodes. All that is required is that the M electrodes have M-fold symmetry about the central axis of the cyclotron motion.

These selection rules for the multiple harmonic detection can be derived as follows. Consider $M=4$ electrodes arranged to have 4-fold symmetry about the central axis of the coherent cyclotron motion of the ions to be observed. The total potential, V(R, M), induced by the circular motion of the charged particles will be the summation of the potentials, $V(R,\omega\theta j)$, induced at each single electrode. The potential $V(R, \theta j,)$ at each electrode differs only in initial phase angle. This leads to $$V(R,M) = \sum_{j=0}^{M-1} (\pm 1)^j V(R,\theta_j) \tag{6a}$$

where $$\begin{aligned} \theta_j &= \omega_c t + \theta_{oj} \\ &= \omega_c t + \frac{2\pi j}{M} \end{aligned} \tag{6b}$$

In Eq. 6*a*, the plus sign is taken when the signal from all the electrodes are summed type I connection) and the minus sign is taken when the sum of signal from every other electrode is subtracted from the sum of the signal from the remaining electrodes (type II connection). Type II connection requires, of course, that M be even.

The Fourier transform expression of $V(R,\theta j)$ is $$V(R,\theta_j) = \frac{A_o}{2} + \sum_{n=1}^{\infty} A_n(R,\theta_j)\cos(n\theta_j) \tag{7a}$$

$$A_n(R,\theta_j) = \frac{2}{\pi} \int_o^{\pi} V(R,\theta_j)\cos(n\theta_j)d\theta_j \tag{7b}$$

Since $V(R, \theta j,)$ is a periodic function with period of $2\pi$, the identity $$\begin{aligned} A_n(R,\theta_j) &= \frac{2}{\pi} \int_o^{\pi} V(R,\omega_c t)d(\omega_c t) \\ &= A_n R \end{aligned}$$

holds by variable substitution.

Combining Eqs. 6–8 gives the total potential induced by the cyclotron motion of the ions at relative radius R at all M electrodes.

$$V(R,M) = \sum_{j=0}^{M-1} (\pm 1)^j A_o/2 + \sum_{n=1}^{\infty} A_n(R) \sum_{j=0}^{M-1} \cos(n\omega_c t + 2n\pi j/M) \tag{9}$$

The nth harmonic signal is thus given by $$V(R,M,n) = A_n \sum_j \cos(n\omega_c t + 2n\pi j/M) \tag{10}$$

By examining the summation over j in Eq. 10, the selection rules can be derived. These are summarized in Table 1. The detailed algebra of deriving the selection rule is given in Appendix B. The magnitude of the potential detected by M electrodes can be finally written as (see Appendix B)

$$V(R,M,\eta^*) = MA_{\eta^*}(R)\cos(\eta^*\omega ct) \tag{11}$$

where $n^*$ is determined by the selection rules summarized in TABLE 1. V (R, M, n) is zero for n values other than $n^*$.

TABLE 1

Selection rules for the detection of harmonics by multipole ICR cells

| Number of electrodes | Connection type[a] | $n^{*b}$ |
|---|---|---|
| M | I | kM |
| M (even) | II | M(2k − 1)/2 |

[a]Defined in FIG. 6
[b]Observed harmonic orders, k = integer

In summary, the important points addressed here are: (1) a symmetrical multiple arrangement of detecting electrodes can selectively detect any order of harmonic signal with an intensity M times stronger than a single electrode; (2) the selection rules are generally applicable for any shape of electrode since the only term the shape of the electrode is the $A_n(R)$ term, which is absent in the derivation of the selection rules.

As a result of this invention increased resolution is obtained in an ICR mass spectrometer. Also increased sensitivity can be obtained.

APPENDIX A

The function in Eq. (2)

$$V_d(R,\theta) = \frac{Q}{4\pi\epsilon_0 R_0[R^2 + 1 - 2R\cos(\omega_c t)]^{\frac{1}{2}}}$$

can be expanded in Legendre polynomials, $P_n[\cos(\omega_c t)]$ yielding (for $R<1$)

$$V_d(R,\theta) = \frac{Q}{4\pi\epsilon_0 R_0} \sum^{\infty} R^n P_n[\cos(\omega_c t)] \quad \text{(A-1)}$$

Fourier analysis of this expression yields, in matrix notation $$V_d(R,\theta) = \frac{Q}{4\pi\epsilon_0 R_0} (R^0, R^1, R^2, \ldots)(b_{ij}) \begin{bmatrix} (\frac{1}{2})\cos(0\omega_c t) \\ \cos(1\omega_c t) \\ \cos(2\omega_c t) \\ \vdots \end{bmatrix} \quad \text{(A-2)}$$

where $b_1$, can be generated from the recursion relation [5]

$$b_{i+1,j} = \frac{2i+1}{2(i+1)}(b_{i,j+1} + b_{i,j-1}) - \frac{i}{i+1} b_{i-1,j} \quad \text{(A-3)}$$

where $b_{oo}=2.b_o,=0(j>0).bij=0(j\neq 1)$. and $b_{11}=1$. Terms on the right side of Eq. (A−3) of the form $b_{1.(0-1)}$ are replaced by $b_{1.+1)}$.

All the diagonal elements of $(b_{ij})$ are non-zero and all elements with $j>i$ are zero. This implies that the nth harmonic of V' is of the form (for $n>O$)

$$A_n \cos(n\omega_c t) = \frac{Q}{4\pi\epsilon_0 R_0} \cos(n\omega_c t) \sum_{i=n}^{\infty} b_{in} R_i \quad \text{(A-4)}$$

At small R, only the leading term in the summation is significant, so at small R the strength of the nth harmonic signal grows as $R^n$. The coefficient $b_{nn}$ is given by $$b_{nn} = 2 \prod_{i=0}^{n-1} [2i+1]/[2(i+1)] \quad \text{(A-5)}$$

for $n>0$.

APPENDIX B

Starting with Eq. (10), let the summation over j be equal to S given by $$S = \sum_{j=0}^{M-1} (\pm 1)^j \cos(n\omega_c t + 2n\pi j/M) \quad \text{(B-1)}$$

Application of a simple trigonometric identify to Eq. (B-1) yields $$S = \cos(n\omega_c t) \sum_j (\pm 1)^j \cos(2n\pi j/M) + \sin(n\omega_c t) \sum_j (\pm 1)^j \sin(2n\pi j/M) \quad \text{(B-2)}$$

The second summation can be shown to be zero by methods completely analogous to those we now use to evaluate the first sum. Therefore, Eq. (B-2) can be further reduced to $$\begin{aligned} S &= \cos(n\omega_c t) \sum_j (\pm 1)^j \cos(2n\pi j/M) \\ &= (\tfrac{1}{2})\cos(n\omega_c t) \times SS \end{aligned}$$

where $$SS = 2 \sum_j (\pm 1)^j \cos(2n\omega j/M) \quad \text{(B-3)}$$

or $$SS = \sum_j (\pm 1)^j \{e^{i(2n\pi j/M)} + e^{-i(2n\pi j/M)}\} \quad \text{(B-4)}$$

Type I connection

For type I connection, as defined in FIG. 4, SS gives $$\begin{aligned} SS &= \sum_j \{e^{i(2n\pi j/M)} + e^{-i(2n\pi j/M)}\} \\ &= \sum_j (X^j + X^{-j}) \end{aligned} \quad \text{(B-5)}$$

where $$X = e^{i2n\pi/M} \quad \text{(B-6)}$$

Let $$S_1 = \sum_{j=1}^{M} X^j \quad \text{(B-7)}$$

$$S_2 = \sum_{j=1}^{M} X^{-j} \quad \text{(B-8)}$$

From Eq. (B-7)

$$S_1 = XS_1 = X - X^{M=1} \quad \text{(B-9)}$$

or $$S_1 = \frac{X(1 - X^M)}{1 - X} \quad (B\text{-}10)$$

Similarly, from Eq. (B-8)

$$S_2 = \frac{1 - X^{-M}}{X - 1} \quad (B\text{-}11)$$

Substituting Eqs. (B-10) and (B-11) into Eq. (B-5) gives $$SS = \frac{X(1 - X^M)}{1 - X} + \frac{(1 - X^{-M})}{X - 1} \quad (B\text{-}12)$$

SS is zero and thus S is zero unless $$1-X=0 \quad (B\text{-}13)$$

and therefore $$X=e^{2n\cdot\pi/M}=1 \quad (B\text{-}14)$$

implying that $$\frac{n^*}{M} = k \quad (B\text{-}15)$$

where k is an integer. This leads to the first selection rule: $n^*=kM$. That is, only harmonics of order $n^*$ will be detected by an M-electrode array with type I connection. The limiting value of S can be obtained by applying L'Hospital's rule to Eq. (B-12) and is found to be M.

Type II connection

For type II connection, as defined in FIG. 4, Eq. (A-2) becomes $$SS = \sum_j \{e^{i(2n\pi/M+\pi)j} + e^{-i(2n\pi/M+\pi)j}\}$$

where $e^{i\pi}$ has been substituted for $-1$.

A treatment similar to that outlined in Eqs. (B-5)-(B-14) shows that $S=0$ unless $$n^* = \frac{(2k - 1)M}{2} \quad (B\text{-}16)$$

where k an integer. This is the second selection rule. That is, only harmonics of order $(2k-1)M/2$ will be detected by an M-electrode array with type II connection. The limiting value of S is again M.

From Eq. (10) and selection rules, the overall potential induced at all M electrodes by the coherent motion of the ions can be finally expressed as $$V(R,M,n^*)=MA_{n\cdot}(R)\cos(n^*\omega_c t) \quad (B\text{-}17)$$

where $n^*$ is given by Eq. (B-15) for type I connection and Eq. (B-16) for type II connection. V(R, M, n) is zero for n not equal to $n^*$.

We claim:

1. A method of detection in an ion cyclotron resonance mass spectrometer in which signals are detected by measuring potential changes, comprising the steps:
   (a) exciting ions in an ion cyclotron resonance cell having a plurality of electrodes to provide a fundamental frequency;
   (b) producing a harmonic of the fundamental frequency; and
   (c) detecting a harmonic signal on an electrode of the ion cyclotron resonance cell.

2. The method of claim 1, further comprising:
   (d) providing a potential differentiation between the plurality of electrodes in the cell, the plurality of electrodes being of an even number of electrodes, M, symmetrically spaced with respect to one another;
   (e) enhancing harmonics of order M $(2k-1)/2$, where k is a positive integer; and
   (f) suppressing the fundamental and all other harmonics.

3. The method of claim 7, further comprising:
   (d) providing a potential summing between the plurality of electrodes in the cell, the plurality of electrodes being a number of electrodes, M, symmetrically spaced with respect to one another;
   (e) enhancing harmonics of an order Mk, where k is a positive integer; and
   (f) suppressing the fundamental and all other harmonics.

4. An ion cyclotron resonance mass spectrometer having electrodes placed so as to provide orbiting ions with a fundamental frequency, comprising:
   a plurality of electrodes symmetrically placed with respect to one another;
   means for inducing voltages in said electrodes; and
   means for differentiating the voltages between said electrodes to suppress a selected set of harmonics in the spectrometer and to enhance a selected set of harmonics.

5. An ion cyclotron resonance mass spectrometer having electrodes placed so as to provide orbiting ions with a fundamental frequency, comprising:
   a plurality of electrodes symmetrically placed with respect to one another;
   means for inducing voltages in said electrodes; and
   means for summing the voltages between said electrodes to suppress a selected set of harmonics in the spectrometer and to enhance a selected set of harmonics.

6. An ion cyclotron resonance as spectrometer having electrodes placed so as to provide orbiting ions with a fundamental frequency, comprising:
   a plurality of electrodes symmetrically placed in clockwise fashion with respect to one another to provide sequentially at least first, second, third and fourth electrodes;
   means for inducing voltages in said electrodes; and
   means for adding the voltages at the first and third electrodes and subtracting the voltages at the second and fourth electrodes from the sum of the voltages of the first and third electrodes so that odd harmonic frequencies are reduced and selected even harmonic frequencies predominate in detection of signals from the orbiting ions.

7. An ion cyclotron resonance mass spectrometer having electrodes placed so as to provide orbiting ions with a fundamental frequency, comprising:
   two pairs of electrodes symmetrically placed with respect to each other to provide first and third electrodes as a pair of second and fourth electrodes as a pair;
   means for inducing voltages in said electrodes; and
   means for adding the voltages at the first and third electrodes and subtracting the voltages of the second and fourth electrodes from the sum of the voltages of the first and third electrodes so that the odd harmonics are reduced and selected even harmonics predominate in detecting of signals from the orbiting ions.

* * * * *